US011114000B2

(12) United States Patent
Jung et al.

(10) Patent No.: US 11,114,000 B2
(45) Date of Patent: Sep. 7, 2021

(54) GATE DRIVER AND METHOD OF REPAIRING THE SAME

(71) Applicant: LG Display Co., Ltd., Seoul (KR)

(72) Inventors: WonJune Jung, Seoul (KR); WooSup Shin, Paju-si (KR); SangMoo Park, Goyang-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/887,748

(22) Filed: May 29, 2020

(65) Prior Publication Data

US 2020/0380898 A1 Dec. 3, 2020

(30) Foreign Application Priority Data

May 31, 2019 (KR) ..... 10-2019-0064749

(51) Int. Cl.
*G09G 3/00* (2006.01)
*G09G 3/20* (2006.01)

(52) U.S. Cl.
CPC ..... *G09G 3/006* (2013.01); *G09G 3/20* (2013.01); *G09G 2300/0426* (2013.01); *G09G 2310/0275* (2013.01); *G09G 2320/04* (2013.01)

(58) Field of Classification Search
CPC .. G09G 3/006; G09G 3/20; G09G 2300/0426; G09G 2310/0275; G09G 2320/04
See application file for complete search history.

(56) References Cited

U.S. PATENT DOCUMENTS

2006/0274021 A1* 12/2006 Park ..... G09G 3/20 345/100
2007/0109250 A1 5/2007 Woo
2007/0132700 A1* 6/2007 Cho ..... G09G 3/3677 345/100
2007/0216634 A1 9/2007 Kim et al.
2010/0001941 A1 1/2010 Shin et al.
2015/0109285 A1* 4/2015 Liang ..... G11C 19/184 345/214
2018/0301103 A1 10/2018 Li et al.

FOREIGN PATENT DOCUMENTS

CN 202736457 U 2/2013
EP 3125225 A1 * 2/2017 ..... H01L 29/78633
JP 2011033846 A * 2/2011
KR 10-2007-0052501 A 5/2007
KR 10-2008-0040448 A 5/2008
KR 10-2013-0070300 A 6/2013

OTHER PUBLICATIONS

Machine translation of JP 011033846. (Year: 2021).*

* cited by examiner

*Primary Examiner* — Michael Pervan
(74) *Attorney, Agent, or Firm* — Birch, Stewart, Kolasch & Birch, LLP

(57) ABSTRACT

According to an aspect of the present disclosure, there is provided a gate driver and a method of repairing the same. The gate driver can include a plurality of driving stages cascade connected, at least one repairing stage disposed between the plurality of driving stages, and a plurality of repair lines connected to the at least one repair stage. The plurality of repair lines overlap with a plurality of lines connected to the plurality of driving stages. The repairing stage can replace a defective driving stage of the gate driver.

17 Claims, 7 Drawing Sheets

GATE DRIVER AND METHOD OF REPAIRING THE SAME

CROSS-REFERENCE TO RELATED APPLICATIONS

This application claims priority to Korean Patent Application No. 10-2019-0064749 filed in the Korean Intellectual Property Office on May 31, 2019, the disclosure of which is incorporated herein by reference in its entirety as if fully set forth herein.

BACKGROUND

Technical Field

The present disclosure relates to a display device and a method of repairing the same, and more specifically to a gate driver implemented by gate-in-panel (GIP) technique and a method of repairing the same.

Description of the Related Art

As the era of information technology has begun, the field of display that represents electrical information signals graphically has been rapidly grown up. In accordance with this, various display devices which are thinner, lighter and consume less power have been developed. Examples of such display devices can include liquid-crystal display devices (LCDs), organic light-emitting display devices (OLEDs), etc.

Such a display device includes a display panel where an array of pixels for displaying images is disposed; and drivers such as a data driver for applying data voltage to data lines disposed in the display panel, a gate driver for supplying a gate pulse sequentially to gate lines disposed in a display area, and a timing controller for controlling the data driver and the gate driver.

Among such drivers, a gate driver is recently incorporated into a display panel of a display device together with an array of pixels by using gate-in-panel (hereinafter referred to as GIP) technique.

A GIP includes a shift register for sequentially outputting a gate voltage, and the shift register includes a plurality of cascaded stages.

A number of stages are cascaded together, so that one stage provides a signal necessary for driving another stage.

Accordingly, if a stage becomes defective, the defective stage can affect the other stages. For example, there can be an issue that if one of the stages included in the GIP becomes defective, the entire GIP may not operate normally.

SUMMARY

An object of the present disclosure is to provide a gate driver and a method of repairing the same, by which the issue of stage failure can be effectively solved or addressed.

Another object of the present disclosure is to provide a gate driver including a repairing stage that can replace a defective driving stage, and a method of repairing the same.

Objects of the present disclosure are not limited to the above-mentioned objects, and other objects, which are not mentioned above, can be clearly understood by those skilled in the art from the following descriptions.

According to an aspect of the present disclosure, there is provided a gate driver including: a plurality of driving stages cascade connected; at least one repairing stage disposed between the plurality of driving stages; and a plurality of repair lines connected to the at least one repair stage. The plurality of repair lines overlap with a plurality of lines connected to the plurality of driving stages. The at least one repairing stage can replace a defective driving stage of the gate driver. In this manner, it is possible to solve or address the issue of failure or limitation of the gate driver.

According to another aspect of the present disclosure, there is provided a method of repairing a gate driver comprising a plurality of driving stages cascade connected; at least one repairing stage disposed between the plurality of driving stages; and a plurality of repair lines connected to the at least one repairing stage and overlapping with a plurality of lines connected to the plurality of driving stages, the method including detecting a defective driving stage from among a plurality of driving stages; cutting input terminals and output terminals of the defective driving stage; and welding the plurality of repair lines and the lines connected to the plurality of driving stages. In this manner, it is possible to solve or address the issue of failure or limitation of the gate driver.

Other detailed matters of the exemplary embodiments are included in the detailed description and the drawings.

According to an exemplary embodiment of the present disclosure, if a driving stage is defective, a repairing stage can replace the defective driving stage, so that the issue of failure or limitation of the gate driver can be solved or addressed.

According to an exemplary embodiment of the present disclosure, if only some transistors of a driving stage are defective, the transistors are replaced with transistors of a repairing stage, so that it is possible to reduce the repair time of a gate driver.

The effects and advantages according to the present disclosure are not limited to the contents exemplified above, and other various effects and advantages are included in the present specification and part of the present disclosure.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain various principles. In the drawings.

DETAILED DESCRIPTION OF THE EMBODIMENTS

Figure 1:
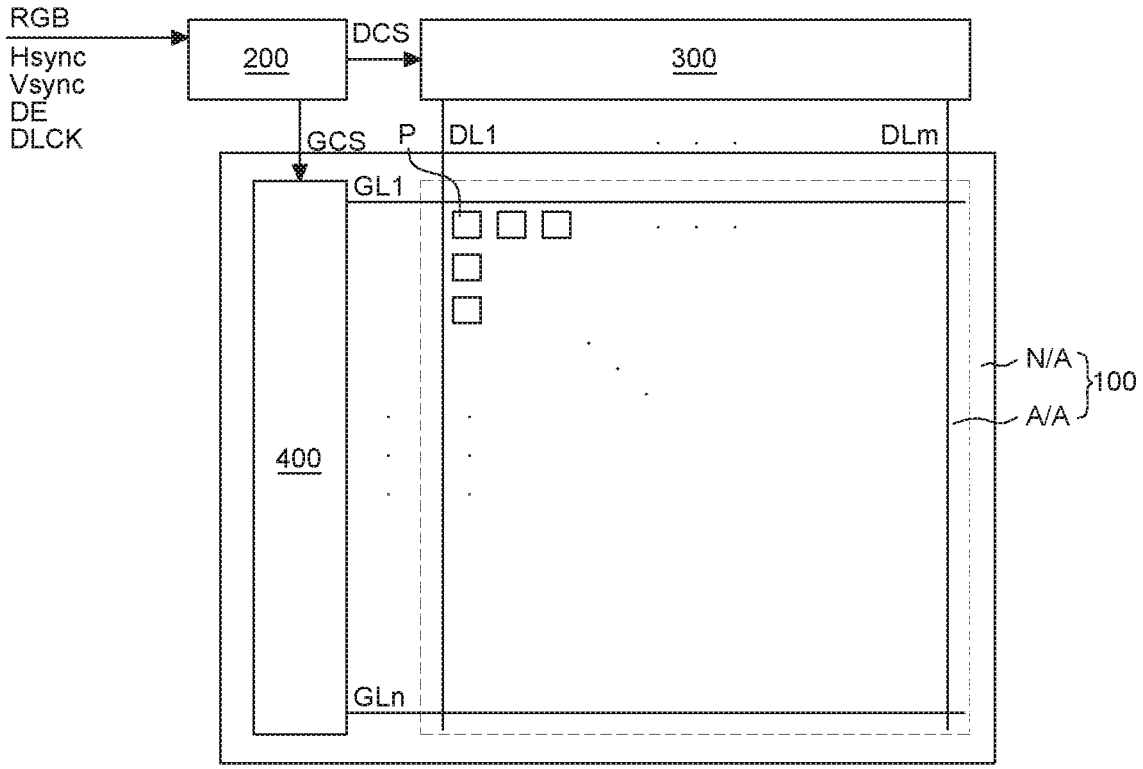
FIG. 1 is a block diagram of a display device according to an exemplary embodiment of the present disclosure.

Advantages and characteristics of the present disclosure and methods of achieving the advantages and characteristics will be clear by referring to exemplary embodiments described below in detail together with the accompanying drawings. However, the present disclosure is not limited to the exemplary embodiments disclosed herein but will be implemented in various forms. The exemplary embodiments are provided by way of example only so that those skilled in the art can fully understand the disclosures of the present disclosure and the scope of the present disclosure. Therefore, the present disclosure will be defined only by the scope of the appended claims.

The shapes, sizes, ratios, angles, numbers, and the like illustrated in the accompanying drawings for describing the exemplary embodiments of the present disclosure are merely examples, and the present disclosure is not limited thereto. Like reference numerals generally denote like elements throughout the specification. Further, in the following description of the present disclosure, a detailed explanation of known related technologies can be omitted to avoid unnecessarily obscuring the subject matter of the present disclosure. The terms such as "including," "having," and "comprising" used herein are generally intended to allow other components to be added unless the terms are used with the term "only". Any references to singular can include plural unless expressly stated otherwise.

Components are interpreted to include an ordinary error range even if not expressly stated.

When the position relation between two parts is described using the terms such as "on", "above", "below", and "next", one or more parts can be positioned between the two parts unless the terms are used with the term "immediately" or "directly".

When an element or layer is disposed "on" another element or layer, it can be directly on the another element or layer, or one or more other layer(s) or element(s) can be interposed therebetween.

Although the terms "first", "second", and the like are used for describing various components, these components are not confined by these terms. These terms are merely used for distinguishing one component from the other components, and do not define any order. Therefore, a first component to be mentioned below can be a second component in a technical concept of the present disclosure.

Same reference numerals generally denote same elements throughout the specification.

A size and a thickness of each component illustrated in the drawing are illustrated for convenience of description, and the present disclosure is not limited to the size and the thickness of the component illustrated.

The features of various embodiments of the present disclosure can be partially or entirely adhered to or combined with each other and can be interlocked and operated in technically various ways, and the embodiments can be carried out independently of or in association with each other.

Hereinafter, a display device according to one or more exemplary embodiments of the present disclosure will be described in detail with reference to accompanying drawings. All the components of the display device according to all embodiments of the present disclosure are operatively coupled and configured.

FIG. 1 is a block diagram of a display device according to an exemplary embodiment of the present disclosure.

Referring to FIG. 1, the display device according to the exemplary embodiment of the present disclosure includes a display panel 100, a timing controller 200, a data driver 300, and a gate driver 400.

The display panel 100 includes a display area A/A where images are displayed, and a non-display area N/A located on the outer side of the display area A/A, where a variety of signal lines and the gate driver 400 are disposed.

In order to display images, a plurality of pixels P is arranged the display area A/A. Further, n gate lines GL1 to GLn arranged in a first direction and m data lines DL1 to DLm arranged in a direction different from the first direction are disposed in the display area A/A, where n and m are positive numbers such as positive integers. The pixels P are electrically connected to the n gate lines GL1 to GLn and the m data lines DL1 to DLm. Accordingly, a gate voltage and a data voltage are applied to each of the pixels P through the gate lines GL1 to GLn and the data lines DL1 to DLm. In addition, each of the pixels P represents a grayscale value by receiving a gate voltage and a data voltage. An image is displayed on the display area A/A by the grayscale values represented by the pixels P.

In the non-display area N/A, a variety of signal lines GL1 to GLn and DL1 to DLm that transmit signals for controlling the operation of the pixels P disposed in the display area A/A, and the gate driver 400 are disposed.

The timing controller 200 receives an input image signal RGB from a host system and transmits it to the data driver 300.

The timing controller 200 uses timing signals such as a clock signal DCLK, a horizontal synchronization signal Hsync, a vertical synchronization signal Vsync and a data enable signal DE received together with the image data RGB to generate control signals GCS and DCS for controlling the operation timing of the gate driver 400 and the data driver 300. The horizontal synchronization signal Hsync refers to a signal indicating the time taken to display a horizontal line of the screen, the vertical synchronization signal Vsync refers to a signal indicating the time taken to display a screen of one frame, and the data enable signal DE refers to a signal indicating a period for applying the data voltage to the pixel P defined in the display panel 100.

In other words, the timing controller 200 receives the timing signal, outputs the gate control signal GCS to the gate driver 400, and outputs the data control signal DCS to the data driver 300.

The data driver 300 receives the data control signal DCS and outputs a data voltage to the data lines DL1 to DLm.

Specifically, the data driver 300 generates a sampling signal according to the data control signal DCS, latches the image data RGB according to the sampling signal to convert it into data voltage, and then applies the data voltage to the data lines DL1 to DLm in response to a source output enable signal SOE.

The data driver 300 can be connected to a bonding pad of the display panel 100 by chip-on-glass (COG) technique or can be disposed directly on the display panel 100. In some implementations, the data driver 300 can be integrated with the display panel 100. In addition, the data driver 300 can be disposed by chip-on-film (COF) technology.

The gate driver 400 sequentially supplies gate voltage to the gate lines GL1 to GLn according to the gate control signal GCS. The gate driver 400 can include a shift register, a level shifter, etc.

Typically, the gate driver can be implemented separately from the display panel and electrically connected to the display panel in a variety of ways. It is to be noted that the gate driver 400 of the display device according to an exemplary embodiment of the present disclosure can be formed as a thin film pattern during the process of fabricating the substrate of the display panel 100, and can be incorporated into the non-display area N/A by using the gate-in-panel (GIP) technique. Although FIG. 1 shows that only the single gate driver 400 is disposed in the non-display area N/A of the display panel 100, the present disclosure is not limited thereto. For example, two or more gate drivers can be disposed.

The gate driver 400 includes a plurality of stages outputting a gate voltage. Hereinafter, the configuration of a gate driver according to an exemplary embodiment of the present disclosure and a method of driving the same will be described in detail.

Figure 2:
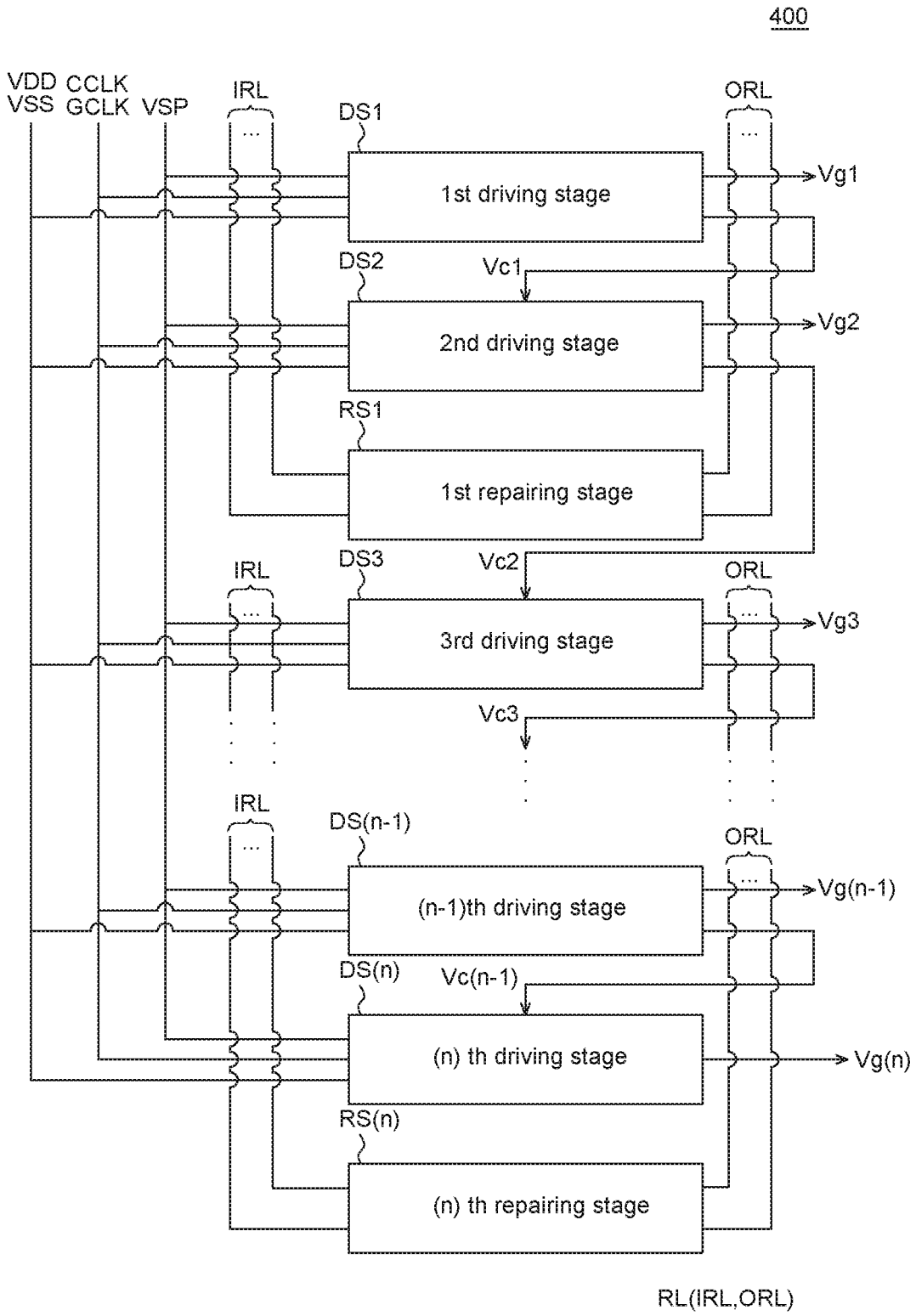
FIG. 2 is a block diagram of a gate driver according to an exemplary embodiment of the present disclosure.

FIG. 2 is a block diagram of a gate driver according to an exemplary embodiment of the present disclosure.

Referring to FIG. 2, the gate driver 400 according to the exemplary embodiment of the present disclosure includes a plurality of driving stages cascade connected DS1 to DS(n), as well as a plurality of repairing stages RS1 to RS(n) disposed between the plurality of driving stages DS1 to DS(n), where n is a positive number such as a positive integer.

The repairing stages RS1 to RS(n) are for repairing the plurality of driving stages DS1 to DS(n), and can be also defined as dummy stages.

The plurality of driving stages DS1 to DS(n) are cascaded, so that the plurality of driving stages DS1 to DS(n) output gate voltages Vg1 to Vg(n), respectively.

Specifically, a gate-start signal VSP and carry voltages Vc1 to Vc(n−1) output from the previous driving stages DS1 to DS(n−1) are input to the driving stages cascade connected DS1 to DS(n), respectively.

For example, the carry voltage Vc1 output from the first driving stage DS1 can be input to the second driving stage DS2, the carry voltage Vc2 output from the second driving stage DS2 can be input to the third driving stage DS3, and the carry voltage Vc(n−1) output from the $(n-1)^{th}$ driving stage DS(n−1) can be input to the nth driving stage DS(n).

In addition, the first to nth driving stages DS1 to DS(n) can receive a high-level supply voltage VDD and a low-level supply voltage VSS, and can output the gate voltages Vg1 to Vg(n) synchronized to the timing of the gate clock signal GCLK, respectively, by the gate-start signal VSP or the carry voltages Vc1 to Vc(n−1) output from the previous driving stages DS1 to DS(n−1).

For example, the first driving stage DS1 receives the gate-start signal VSP at the start timing of a frame and outputs the first gate voltage Vg1 using the gate clock signal GCLK. Subsequently, the second driving stage DS2 to the nth driving stage DS(n) outputs the second to nth gate voltages Vg2 to Vg(n) sequentially using a number of gate clock signals GCLK according to the carry voltages Vc1 to Vc(n−1) output from the previous driving stages DS1 to DS (n−1), respectively.

As described above, the plurality of driving stages DS1 to DS(n) can sequentially output the gate voltages Vg1 to Vg(n), respectively, to form a single frame.

The repairing stages RS1 to RS(n) are disposed between the plurality of driving stages DS1 to DS(n). If any of the plurality of driving stages DS1 to DS(n) is defective, one of the repairing stages RS1 to RS(n) replaces the defective driving stage.

Specifically, the repairing stages RS1 to RS(n) can be disposed between the plurality of driving stages DS1 to DS(n) regularly. In other words, the repairing stages RS1 to RS(n) can be disposed between the plurality of driving stages DS1 to DS(n) with a constant or equal spacing.

As an example, as shown in FIG. 2, the first repairing stage RS1 for repairing the first driving stage DS1 and the second driving stage DS2 can be disposed under the first driving stage DS1 and the second driving stage DS2. In addition, the nth repairing stage RS(n) for repairing the $(n-1)^{th}$ driving stage DS(n−1) and the nth driving stage DS(n) can be disposed under the $(n-1)^{th}$ driving stage DS(n−1) and the nth driving stage DS(n).

Although the repairing stages RS1 to RS(n) are arranged regularly between the plurality of driving stages DS1 to DS(n) in the example shown in FIG. 2, the present disclosure is not limited thereto. The repairing stages RS1 to RS(n) can be arranged irregularly depending on the design choice.

In addition, a plurality of repair lines RL can be connected to each of the input and output terminals of the plurality of repairing stages RS1 to RS(n).

Specifically, a plurality of input repair lines IRL is connected to the input terminal of each of the repairing stages RS1 to RS(n). In addition, a plurality of output repair lines ORL is connected to the output terminal of each of the repairing stages RS1 to RS(n).

In addition, the input repair lines IRL are formed on a different layer from the lines connected to the input terminals of the adjacent driving stages DS1 to DS(n), and are electrically separated from but overlap with them.

In addition, the output repair lines ORL are formed on a different layer from the lines connected to the output terminals of the adjacent driving stages DS1 to DS(n), and are electrically separated from but overlap with them.

Specifically, in the example shown in FIG. 2, the input repair lines IRL connected to the first repairing stage RS1 overlap with the high-level voltage VDD supply line, the low-level voltage VSS supply line, the gate clock signal GCLK supply line, the carry clock signal CCLK supply line and the gate-start signal VSP supply line connected to the input terminals of the first driving stage DS1, and with the high-level voltage VDD supply line, the low-level voltage VSS supply line, the gate clock signal GCLK supply line, the carry clock signal CCLK supply line and the gate-start signal VSP supply line connected to the input terminals of the second driving stage DS2.

In addition, in the example shown in FIG. 2, the output repair lines ORL connected to the first repairing stage RS1 overlap with a first gate line on which the first gate voltage Vg1 is output and a first carry line on which the first carry voltage Vc1 is output connected to the output terminals of the first driving stage DS1, and with a second gate line on which the second gate voltage Vg2 is output and a second carry line on which the second carry voltage Vc2 is output connected to the output terminals of the second driving stage DS2.

Specifically, in the example shown in FIG. 2, the input repair lines IRL connected to the nth repairing stage RS(n) overlap with the high-level voltage VDD supply line, the low-level voltage VSS supply line, the gate clock signal GCLK supply line, the carry clock signal CCLK supply line and the gate-start signal VSP supply line connected to the input terminals of the $(n-1)^{th}$ driving stage DS(n−1), and with the high-level voltage VDD supply line, the low-level voltage VSS supply line, the gate clock signal GCLK supply line, the carry clock signal CCLK supply line and the gate-start signal VSP supply line connected to the input terminals of the nth driving stage DS(n).

In addition, in the example shown in FIG. 2, the output repair lines ORL connected to the nth repairing stage RS(n) overlap with a $(n-1)^{th}$ gate line on which the $(n-1)^{th}$ gate voltage Vg(n−1) is output and a $(n-1)^{th}$ carry line on which the $(n-1)^{th}$ carry voltage Vc(n−1) is output connected to the output terminals of the $(n-1)^{t}$ driving stage DS(n−1), and with an nth gate line on which the nth gate voltage Vg(n) is output and a nth carry line on which the nth carry voltage Vc(n) is output connected to the output terminals of the nth driving stage DS(n).

As the plurality of repair lines RL overlap the above-described lines, the first repairing stage RS1 can replace the first driving stage DS1 or the second driving stage DS2 which is defective via a cutting and welding process to be described with reference to FIG. 4. Likewise, the nth repairing stage RS(n) can replace the $(n-1)^{t}$ driving stage DS(n−1) or the nth driving stage DS(n) which is defective via the cutting and welding process to be described with reference to FIG. 4.

It is to be understood that the structure of the plurality of repair lines RL is not limited to that described above but can be altered depending on design choice.

For example, in the example shown in FIG. 2, the plurality of repair lines RL connected to each of the plurality of repairing stages RS1 to RS(n) overlap the input terminals and output terminals of the plurality of driving stages DS1 to DS(n) disposed on the upper side thereof. In some implementations, the plurality of repair lines RL connected to each of the plurality of repairing stages RS1 to RS(n) can overlap with the input terminals and output terminals of a plurality of driving stages DS1 to DS(n) disposed on the lower side thereof as well as the input terminals and output terminals of a plurality of driving stages DS1 to DS(n) disposed on the upper side thereof.

Hereinafter, the configuration of each of the plurality of driving stages DS1 to DS(n) and a manner of driving the same will be described in detail.

Switch elements forming each of the plurality of driving stages DS1 to DS(n) can be implemented as n-type or p-type MOSFETs. In the following description, n-type transistors will be described, but it is to be understood that the present disclosure is not limited thereto.

Herein, the transistor is a three-electrode device including a gate electrode, a source electrode, and a drain electrode. The source electrode is used to supply carriers to the transistor. In the transistor, carriers begin to flow from the source electrode. The carriers exit via the drain electrode of the transistor. In other words, the carriers flow from the source electrode to the drain electrode in the MOSFET. For an n-type MOSFET (NMOS) where electrons are carriers, the voltage at the source electrode is lower than the voltage at the drain electrode to allow the electrons to flow from the source electrode to the drain electrode. As the electrons flow from the source electrode to the drain electrode in the n-type MOSFET, electric current flows from the drain electrode to the source electrode. For a p-type MOSFET (PMOS) where holes are carriers, the voltage at the source electrode is higher than the voltage at the drain electrode to allow the holes to flow from the source electrode to the drain electrode. As the holes flow from the source electrode to the drain electrode in the p-type MOSFET, electric current flows from the source electrode to the drain electrode. It is to be noted that the source and drain electrodes of the MOSFET are not fixed. For example, the source electrode and the drain electrode of the MOSFET can be switched depending on the applied voltage. In the following description, the present disclosure is not limited by the source and drain electrodes of the transistor.

In the following description, the source electrode of a transistor is referred to as a first electrode, and the drain electrode of the transistor is referred to as a second electrode. It is to be noted that the source electrode of a transistor can be referred to as a second electrode, and the drain electrode of the transistor can be referred to as a first electrode depending on the type of transistor.

In addition, in each driving stage DS1 to DS(n) of the gate driver 400 according to the exemplary embodiment of the present disclosure, a low-temperature poly-silicon (hereinafter referred to as LTPS) transistor that uses a polycrystalline semiconductor material as an active layer can be employed. Since the poly-silicon material has high mobility (100 $cm^2/Vs$ or more), it has low energy consumption and excellent reliability, and thus can be applied for transistors for driving elements.

Figure 3A:
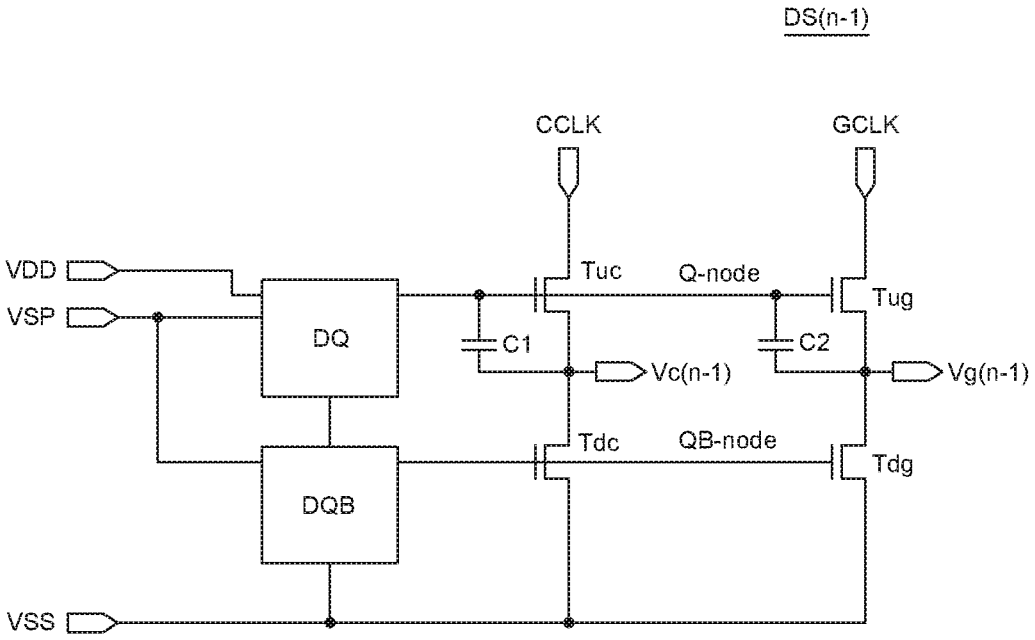
FIG. 3A is a circuit diagram showing each driving stage of a gate driver according to an exemplary embodiment of the present disclosure.

FIG. 3A is a circuit diagram showing each driving stage of a gate driver according to an exemplary embodiment of the present disclosure.

Referring to FIG. 3A, the $(n-1)^{th}$ driving stage DS(n−1) of the gate driver 400 according to the exemplary embodiment of the present disclosure includes a Q-node control unit DQ, a QB-node control unit DQB, a carry-voltage output unit Tuc, Tdc and C1, and a gate-voltage output unit Tug, Tdg and C2.

The Q-node control unit DQ controls the voltage at the Q-node. In other words, the Q-node control unit DQ determines charging and discharging timing of the Q-node.

Specifically, the Q-node control unit DQ receives the high-level supply voltage VDD and the gate-start signal VSP, and receives a control signal from the QB-node control unit DQB to determine the charging and discharging timing of the Q-node.

The QB-node control unit DQB controls the voltage at the QB-node. In other words, the QB-node control unit DQB determines charging and discharging timing of the QB-node.

Specifically, the QB-node control unit DQB receives the low-level supply voltage VSS and the gate-start signal VSP, and receives a control signal from the Q-node control unit DQ to determine the charging and discharging timing of the QB-node.

The carry-voltage output unit Tuc, Tdc and C1 outputs the carry voltage Vc(n−1) according to the voltage at the Q-node and the voltage at the QB-node.

Specifically, the carry-voltage output unit Tuc, Tdc and C1 includes a carry pull-up transistor Tuc that pulls up a carry voltage Vc(n−1), a carry pull-down transistor Tdc that pulls down the carry voltage Vc(n−1), and a first capacitor C1 for bootstrapping.

The gate electrode of the carry pull-up transistor Tuc is connected to the Q-node, the first electrode of the carry pull-up transistor Tuc is connected to the carry clock signal CCLK supply line, and the second electrode of the carry pull-up transistor Tuc is connected to the $(n-1)^{th}$ carry line from which the $(n-1)^{th}$ carry voltage Vc(n−1) is output. Accordingly, when the Q-node is being charged, the carry pull-up transistor Tuc is turned on to output the high-level carry clock signal CCLK as the $(n-1)^{th}$ carry voltage Vc(n−1).

The gate electrode of the carry pull-down transistor Tdc is connected to the QB-node, the first electrode of the carry pull-down transistor Tdc is connected to the low-level supply voltage VSS, and the second electrode of the carry pull-down transistor Tdc is connected to the $(n-1)^{th}$ carry line from which the $(n-1)^{th}$ carry voltage Vc(n−1) is output. Accordingly, when the QB-node is being charged, the carry pull-down transistor Tdc is turned on to output the low-level supply voltage VSS as the $(n-1)^{th}$ carry voltage Vc(n−1).

In addition, the first capacitor C1 is used for bootstrapping of the Q-node.

Specifically, one end of the first capacitor C1 is connected to the gate electrode of the carry pull-up transistor Tuc, and the other end of the first capacitor C1 is connected to the second electrode of the carry pull-up transistor Tuc. Accordingly, while the Q-node is being charged, if the carry clock signal CCLK output from the second electrode of the carry pull-up transistor Tuc is raised to the high-level, the Q-node can be bootstrapped by the first capacitor C1.

The gate-voltage output unit Tug, Tdg and C2 outputs the gate voltage Vg(n−1) according to the voltage at the Q-node and the voltage at the QB-node.

Specifically, the gate-voltage output unit Tug, Tdg and C2 includes a gate pull-up transistor Tug that pulls up a gate voltage Vg(n−1), a gate pull-down transistor Tdg that pulls down the gate voltage Vg(n−1), and a second capacitor C2 for bootstrapping.

The gate electrode of the gate pull-up transistor Tug is connected to the Q-node, the first electrode of the gate pull-up transistor Tug is connected to the gate clock signal GCLK supply line, and the second electrode of the gate pull-up transistor Tug is connected to the $(n-1)^{th}$ gate line from which the $(n-1)^{th}$ gate voltage Vg(n−1) is output. Accordingly, when the Q-node is being charged, the gate pull-up transistor Tug is turned on to output the high-level gate clock signal GCLK as the $(n-1)^{th}$ gate voltage Vg(n−1).

The gate electrode of the gate pull-down transistor Tdg is connected to the QB-node, the first electrode of the gate pull-down transistor Tdg is connected to the low-level supply voltage VSS, and the second electrode of the gate pull-down transistor Tdg is connected to the $(n-1)^{th}$ gate line from which the $(n-1)^{t}$ gate voltage Vg(n−1) is output. Accordingly, when the QB-node is being charged, the gate pull-down transistor Tdg is turned on to output the low-level supply voltage VSS as the $(n-1)^{th}$ gate voltage Vg(n−1).

In addition, the second capacitor C2 is used for bootstrapping of the Q-node.

Specifically, one end of the second capacitor C2 is connected to the gate electrode of the gate pull-up transistor Tug, and the other end of the second capacitor C2 is connected to the second electrode of the gate pull-up transistor Tug. Accordingly, while the Q-node is being charged, if the gate clock signal GCLK output from the second electrode of the gate pull-up transistor Tug is raised to the high-level, the Q-node can be bootstrapped by the second capacitor C2.

Figure 3B:
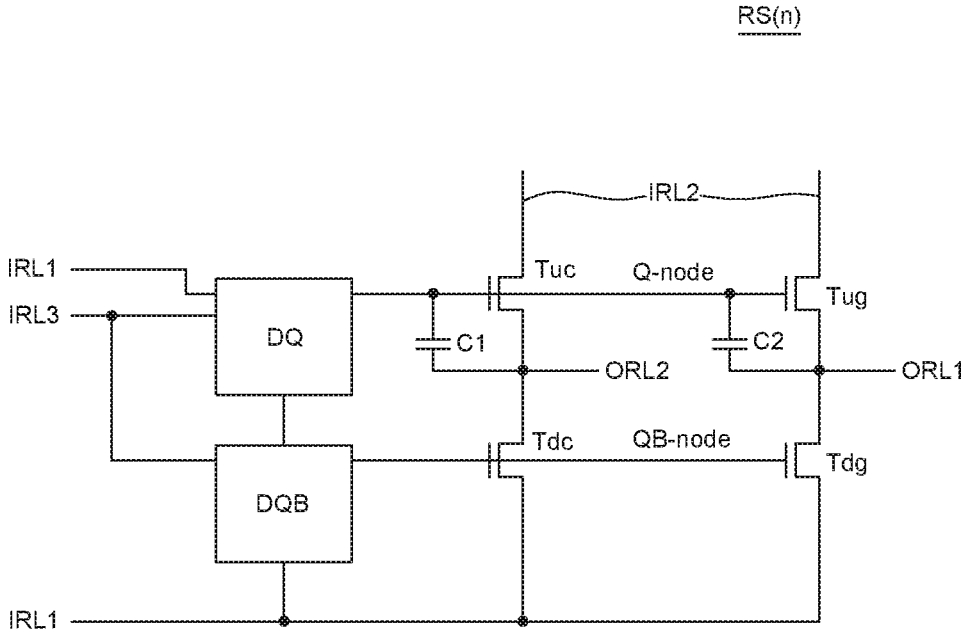
FIG. 3B is a circuit diagram showing each repairing stage of a gate driver according to an exemplary embodiment of the present disclosure.

FIG. 3B is a circuit diagram showing each repairing stage of a gate driver according to an exemplary embodiment of the present disclosure.

Referring to FIG. 3B, the nth repairing stage RS(n) of the gate driver 400 according to the exemplary embodiment of the present disclosure includes a Q-node control unit DQ, a QB-node control unit DQB, a carry-voltage output unit Tuc, Tdc and C1, and a gate-voltage output unit Tug, Tdg and C2.

Since the nth repairing stage RS(n) replace a defective one of the plurality of driving stages DS1 to DS(n), the nth repairing stage RS(n) has the same configuration as the plurality of driving stages DS1 to DS(n). Therefore, descriptions of the identical elements will not be made to avoid redundancy.

The difference is that a plurality of input repair lines IRL is connected to the input terminals of the nth repairing stage RS(n), and a plurality of output repair lines ORL is connected to the output terminals of the nth repairing stage RS(n).

Specifically, the first to third input repair lines IRL1 to IRL3 are connected to the input terminals of the nth repairing stage RS(n), and the first and second output repair lines ORL1 and ORL2 are connected to the output terminals of the nth repairing stage RS(n).

As an example, the connection relationship between the input repair lines IRL and the output repair lines ORL will be described by comparing FIG. 3A with 3B as follows.

The first input repair line IRL1 connected to the nth repairing stage RS(n) replaces the low-level voltage VSS supply line and the high-level voltage VDD supply line connected to each of the plurality of driving stages DS1 to DS(n).

The second input repair line IRL2 connected to the nth repairing stage RS(n) replaces the carry clock signal CCLK supply line and the gate clock signal GCLK supply line connected to each of the plurality of driving stages DS1 to DS(n).

The third input repair line IRL3 connected to the nth repairing stage RS(n) replaces the gate-start signal VSP supply line connected to each of the plurality of driving stages DS1 to DS(n).

The first output repair line ORL1 connected to the nth repairing stage RS(n) replaces the $(n-1)^{th}$ gate line of each of the plurality of driving stages DS1 to DS(n), from which the $(n-1)^{th}$ gate voltage Vg(n−1) is output.

In addition, the second output repair line ORL2 connected to the nth repairing stage RS(n) replaces the $(n-1)^{th}$ carry line of each of the plurality of driving stages DS1 to DS(n), from which the $(n-1)^{th}$ carry voltage Vc(n−1) is output.

Hereinafter, a repairing operation by a gate driver according to an exemplary embodiment of the present disclosure will be described with reference to FIG. 4.

Figure 4:
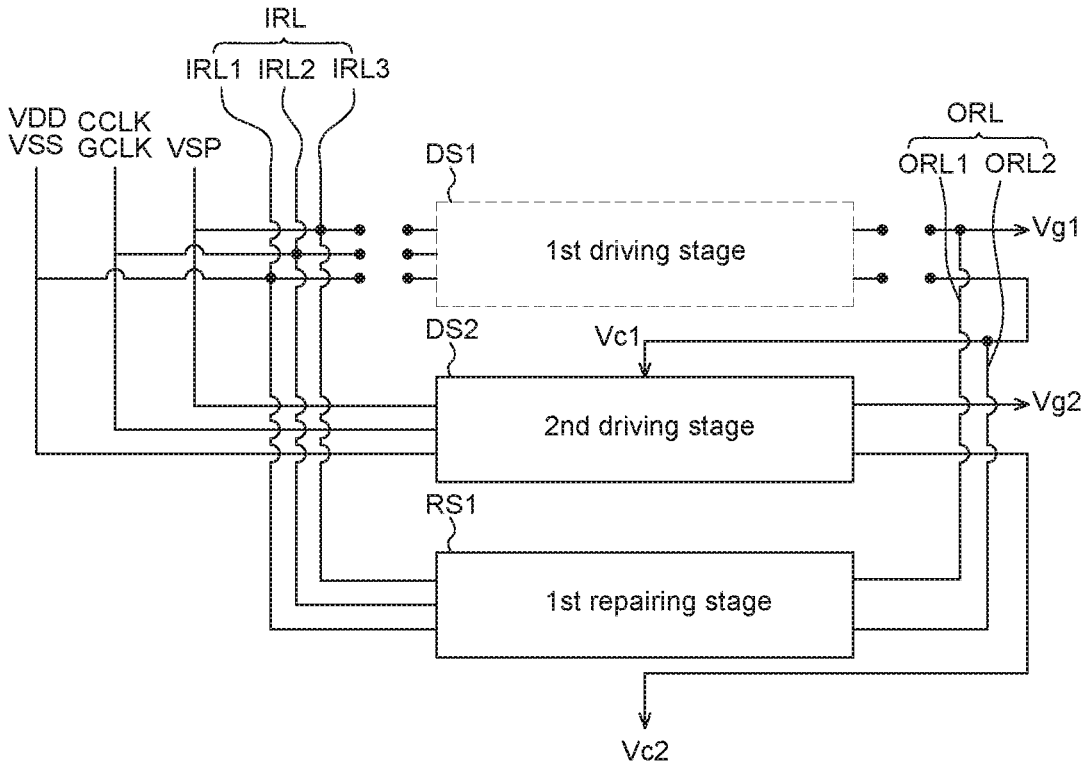
FIG. 4 is a diagram for illustrating a repairing operation by a gate driver according to an exemplary embodiment of the present disclosure.

FIG. 4 is a diagram for illustrating a repairing operation by a gate driver according to an exemplary embodiment of the present disclosure.

Specifically, FIG. 4 shows an example where it is determined that the first driving stage DS1 is defective, and thus the first driving stage DS1 is replaced with the first repairing stage RS1.

If it is determined that the first driving stage DS1 is defective, both the input terminals and the output terminals of the first driving stage DS1 are cut.

The cutting the input terminals of the first driving stage DS1 means that the low-level voltage VSS supply line, the high-level voltage VDD supply line, the carry clock signal CCLK supply line, the gate clock signal GCLK supply line and the gate-start signal VSP supply line are electrically separated from the input terminals of the first driving stage DS1.

The cutting the output terminals of the first driving stage DS1 means that the first carry line and the first gate line are electrically separated from the output terminals of the first driving stage DS1.

Then, the first input repair line IRL1 is electrically connected to the low-level voltage VSS supply line and the high-level voltage VDD supply line. As a result, the low-level supply voltage VSS and the high-level supply voltage VDD can be applied to the first repairing stage RS1.

The second input repair line IRL2 is electrically connected to the carry clock signal CCLK supply line and the gate clock signal GCLK supply line. As a result, the carry clock signal CCLK and the gate clock signal GCLK can be applied to the first repairing stage RS1.

Then, the third input repair IRL3 line is electrically connected to the gate-start signal supply line VSP. As a result, the gate-start signal VSP can be applied to the first repairing stage RS1.

The first output repair line ORL1 is electrically connected to the first gate line. As a result, the first repairing stage RS1 can output the first gate voltage Vg1 to the first gate line.

The second output repair line ORL2 is electrically connected to the first carry line. Accordingly, the first repairing stage RS1 can output the first carry voltage Vc1 to the second driving stage.

As described above, the low-level voltage VSS supply line, the high-level voltage VDD supply line, the carry clock signal CCLK supply line, the gate clock signal GCLK supply line and the gate-start signal VSP supply line can be electrically connected to the input repair lines IRL, and the first gate line from which the first gate voltage Vg1 is output and the first carry line from which the first carry voltage Vc1 is output can be connected to the output repair lines ORL.

Accordingly, even if the first driving stage DS1 is defective, the first repairing stage RS1 can work on behalf of the first driving stage DS1.

In this manner, the other driving stages DS2 to DS(n) connected to the first repairing stage RS1 can also work normally, and thus the gate driver 400 can work normally even though the first driving stage DS1 is defective.

Incidentally, since the vertical length of the display panel is limited, the length L1 of the plurality of repair lines is inversely proportional to the number of repairing stages RS1 to RS(n).

Specifically, the larger the length L1 of the plurality of repair lines is, the smaller the number of repairing stages RS1 to RS(n) can be. On the other hand, the smaller the length L1 of the plurality of repair lines is, the larger the number of repairing stages RS1 to RS(n) can be.

Hereinafter, an electrical connection relationship between a repair line RL and a gate line will be described with reference to FIGS. 5A and 5B.

Figure 5A:
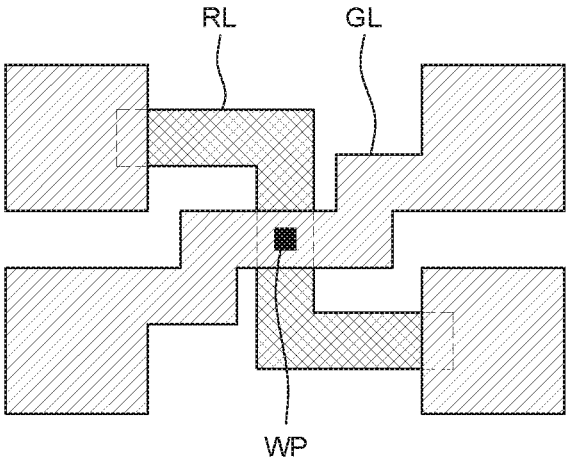
FIGS. 5A and 5B are diagrams for illustrating a connection relationship between a repair line and a gate line of a gate driver according to an exemplary embodiment of the present disclosure.
Figure 5B:
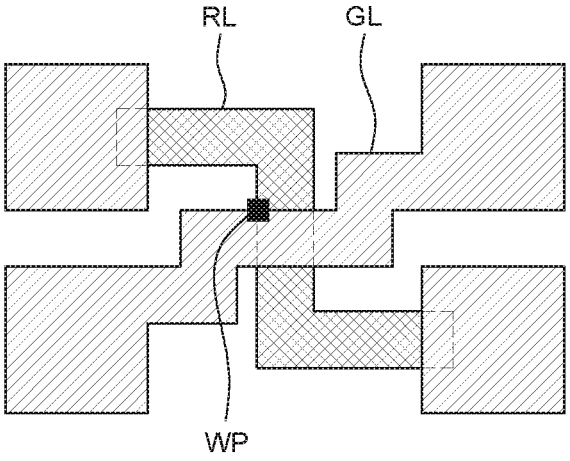

FIGS. 5A and 5B are diagrams for illustrating a connection relationship between a repair line and a gate line of a gate driver according to an exemplary embodiment of the present disclosure.

As described above with reference to FIG. 4, a plurality of input repair lines IRL overlaps a plurality of lines connected to input terminals of adjacent driving stages DS1 to DS(n), and a plurality of output repair lines ORL overlaps a plurality of lines connected to output terminals of adjacent driving stages DS1 to DS(n).

By welding the portions where they overlap each other, the plurality of input repair lines IRL can be electrically connected to the plurality of lines connected to the input terminals of the adjacent driving stages DS1 to DS(n), and the plurality of output repair lines ORL can be electrically connected to the plurality of lines connected to the output terminals of the adjacent driving stages DS1 to DS(n).

For example, FIGS. 5A and 5B show welding the portion where the gate line GL overlaps with the repair line RL, and a position where welding is carried out is defined as a welding point WP.

Referring to FIG. 5A, the center of the portion where the gate line GL overlaps with the repair line RL can be welded. In other words, the welding point WP can be located at the center of the portion where the gate line GL overlaps with the repair line RL. Accordingly, the gate line GL and the repair line RL are physically connected with each other at the welding point WP, and can be electrically connected with each other.

Alternatively, referring to FIG. 5B, a corner of the portion where the gate line GL overlaps with the repair line RL can be welded. Specifically, the welding point WP can be located at the corner of the portion where the gate line GL overlaps with the repair line RL. Accordingly, the gate line GL and the repair line RL are physically connected with each other at the welding point WP, and can be electrically connected with each other.

In addition, even if a first welding may fail on a corner of the portion, a second welding can be attempted at another corner. Accordingly, the repair efficiency of the gate driver can be increased effectively.

Hereinafter, a gate driver according to another exemplary embodiment of the present disclosure will be described with reference to FIG. 6.

The gate driver according to this exemplary embodiment is different from the gate driver according to the above-described exemplary embodiment in the connection relationship of input repair lines IRL. Therefore, the description will focus on the difference.

Figure 6:
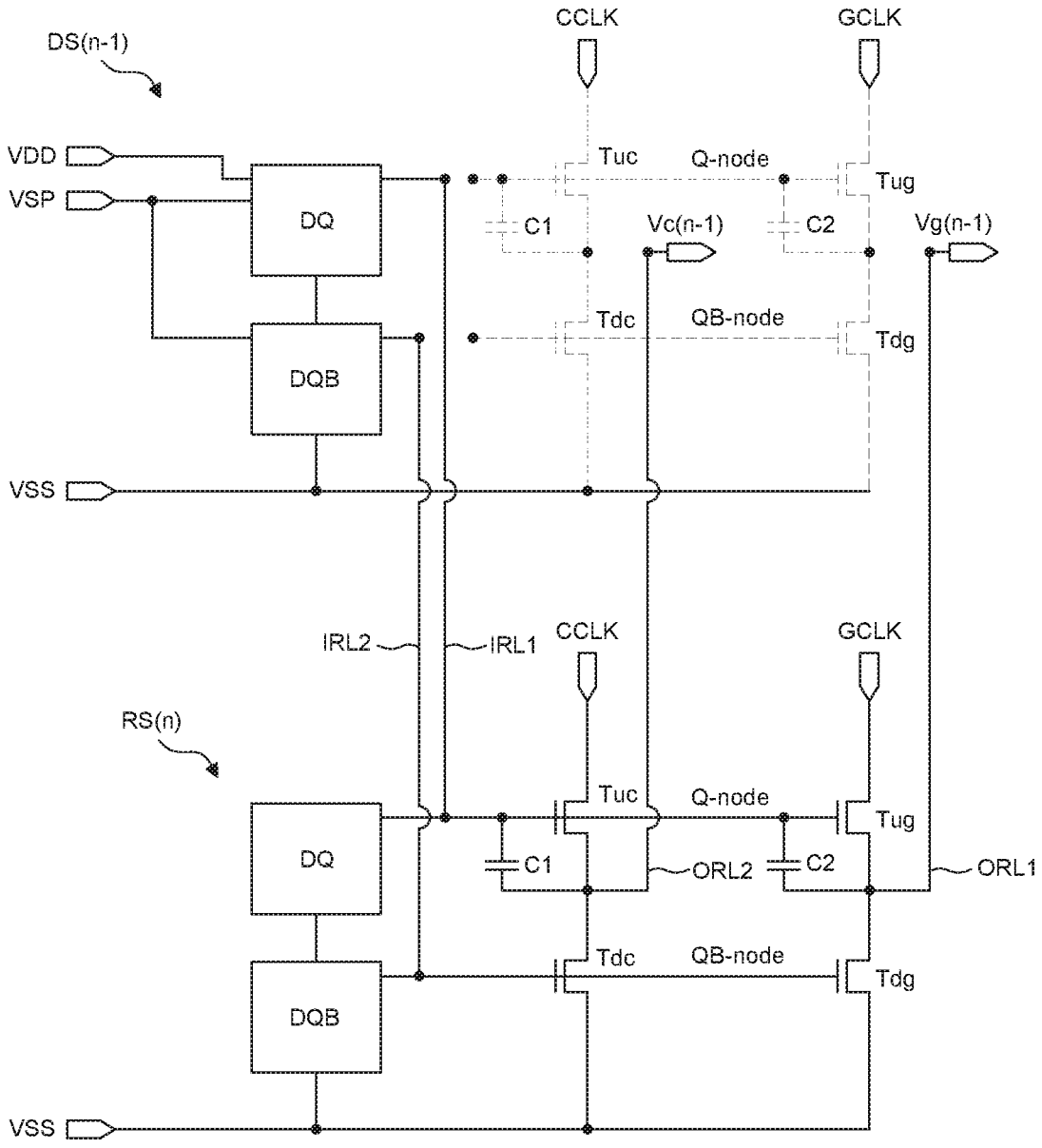
FIG. 6 is a diagram for illustrating a repairing operation by a gate driver according to another exemplary embodiment of the present disclosure.

FIG. 6 is a diagram for illustrating a repairing operation by a gate driver according to another exemplary embodiment of the present disclosure.

Specifically, in FIG. 6, it is determined that a carry-voltage output unit Tu, Tdc and C1 and a gate-voltage output unit Tu, Tdg and C2 of the (n−1)th driving stage DS(n−1) are defective, and thus the carry-voltage output unit Tu, Tdc and C1 and the gate-voltage output unit Tu, Tdg and C2 of the (n−1)th driving stage DS(n−1) are replaced with a carry-voltage output unit Tuc, Tdc and C1 and a gate-voltage output unit Tug, Tdg and C2 of the nth repairing stage RS(n).

More specifically, the carry-voltage output unit Tuc, Tdc and C1 and the gate-voltage output unit Tug, Tdg and C2 occupy more than 60% of the total area of the (n−1)th driving stage DS(n−1). Therefore, if a driving failure or problem occurs in the (n−1)th driving stage DS(n−1), it is very likely that the carry-voltage output unit Tuc, Tdc C1 and the gate-voltage output unit Tug, Tdg C2 are defective.

Accordingly, according to this exemplary embodiment, the carry-voltage output unit Tuc, Tdc and C1 and the gate-voltage output unit Tug, Tdg and C2 of the (n−1)th driving stage DS(n−1) are replaced with the carry-voltage output unit Tuc, Tdc and C1 and the gate-voltage output unit Tug, Tdg and C2 of the nth repairing stage RS(n).

More specifically, if it is determined that the carry-voltage output unit Tuc, Tdc and C1 and the gate-voltage output unit Tug, Tdg and C2 are defective, the Q-node, the QB-node and the output terminals of the (n−1)th driving stage DS(n−1) are all cut.

The cutting the Q-node of the (n−1)th driving stage DS(n−1) means that the Q-node control unit DQ and the Q-node are electrically separated from the (n−1)th driving stage DS(n−1).

The cutting the QB-node of the (n−1)th driving stage DS(n−1) means that the QB-node control unit DQB and the QB-node are electrically separated from the (n−1)th driving stage DS(n−1).

The cutting the output terminals of the (n−1)th driving stage DS(n−1) means that the (n−1)th carry line and the (n−1)th gate line are electrically separated from the output terminals of the (n−1)th driving stage DS(n−1).

Subsequently, the first input repair line IRL1 electrically connects the Q-node control unit DQ of the (n−1)th driving stage DS(n−1) with the Q-node of the nth repairing stage RS(n). By doing so, a signal output from the Q-node control unit DQ of the (n−1)th driving stage DS(n−1) can be applied to the Q-node of the nth repairing stage RS(n).

Subsequently, the second input repair line IRL2 electrically connects the QB-node control unit DQB of the (n−1)th driving stage DS(n−1) with the QB-node of the nth repairing stage RS(n). By doing so, a signal output from the QB-node control unit DQB of the (n−1)th driving stage DS(n−1) can be applied to the QB-node of the nth repairing stage RS(n).

The first output repair line ORL1 is electrically connected to the (n−1)th gate line. Accordingly, the nth repairing stage RS(n) can output the gate voltage Vg(n−1) to the (n−1)th gate line.

The second output repair line ORL2 is electrically connected to the (n−1)th carry line. Accordingly, the nth repairing stage RS(n) can output the carry voltage Vc(n−1) to the nth driving stage DS(n).

In this manner, even if the carry-voltage output unit Tuc, Tdc and C1 and the gate-voltage output unit Tug, Tdg and C2 of the (n−1)th driving stage DS(n−1) are defective, the carry-voltage output unit Tuc, Tdc and C1 and the gate-voltage output unit Tug, Tdg, and C2 of the nth repairing stage RS(n) can work on behalf of the them.

As a result, according to the exemplary embodiment of the present disclosure, it is also possible to solve the issue of the gate driver 400 when the (n−1)th driving stage DS(n−1) is defective.

Additionally, unlike the above-described exemplary embodiment, only the Q-node and QB-node are cut and welded rather than all of the lines connected to the input terminals of the driving stage. As a result, the number of welding points can be reduced.

Accordingly, the gate driver can be repaired more easily, and thus the repair time can be reduced.

Hereinafter, a method of repairing a gate driver according to an exemplary embodiment of the present disclosure will be described.

The method of repairing the gate driver according to an exemplary embodiment of the present disclosure will be described by using the gate driver having the above-described configuration.

Figure 7:
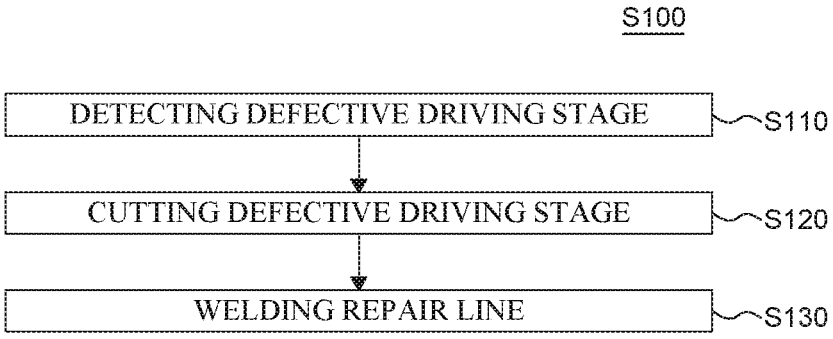
FIG. 7 is a flowchart for illustrating a method of repairing a gate driver according to an exemplary embodiment of the present disclosure.

FIG. 7 is a flowchart for illustrating a method of repairing a gate driver according to an exemplary embodiment of the present disclosure. This method can be implemented using any gate driver of the present disclosure.

Referring to FIG. 7, a method (S100) of repairing a gate driver according to an exemplary embodiment of the present disclosure includes detecting a defective driving stage (step S110), cutting the defective driving stage (step S120), and welding repair lines (step S130).

The detecting the defective driving stage S110 includes detecting any defective driving stage DS1 to DS(n) from among the plurality of driving stages DS1 to DS(n) included in the gate driver.

Specifically, an image on the entire display panel is inspected by naked eyes to determine whether there is any defective line. In another example, this inspection may be performed using a machine/tool/software.

Then, which one of the plurality of driving stages DS1 to DS(n) is associated with the defective line is accurately detected by using an electron microscope.

In this manner, it is possible to detect the defective driving stage among the plurality of driving stages DS1 to DS(n).

Subsequently, the cutting the defective driving stage S120 includes cutting the input terminals and output terminals of the defective stage.

The cutting the input terminals of the defective driving stage means that the low-level voltage VSS supply line, the high-level voltage VDD supply line, the carry clock signal CCLK supply line, the gate clock signal GCLK supply line and the gate-start signal VSP supply line are electrically separated from the input terminals of the defective driving stage.

The cutting the output terminals of the defective driving stage means that the carry line and the gate line are electrically separated from the output terminals of the defective driving stage.

The cutting can be carried out by irradiating a high-frequency laser onto a line to be cut and physically separating the line. The cutting can be carried out in other ways as long as the lines can be electrically separated from the terminals.

Subsequently, the welding the plurality of repair lines S130 includes welding the plurality of repair lines RL and a plurality of lines overlapping them, thereby electrically connecting the plurality of repair lines RL with the plurality of lines.

Specifically, the input repair lines IRL overlap a plurality of lines cut from the input terminals of the defective driving stages DS1 to DS(n), and the portions where they overlap the lines are welded, as described above.

Referring to FIG. 4, for example, the first input repair line IRL1 is welded at the portion where it overlaps the low-level voltage VSS supply line and the high-level voltage VDD supply line cut from the defective driving stage DS1.

The second input repair line IRL2 is welded at the portion where it overlaps the carry clock signal CCLK supply line and the gate clock signal GCLK supply line cut from the defective driving stage DS1.

The third input repair line IRL3 is welded at the portion where it overlaps the gate-start signal VSP supply line cut from the defective driving stage DS1.

The plurality of output repair lines ORL overlap a plurality of lines cut from the output terminals of the defective driving stages.

Referring to FIG. 4, for example, the first output repair line ORL1 is welded at the portion where it overlaps the first gate line cut from the defective driving stage DS1, from which the first gate voltage Vg1 is output.

The second output repair line ORL2 is welded at the portion where it overlaps the first carry line cut from the defective driving stage DS1, from which the first carry voltage Vc1 is output.

As described above, by welding the portions where they overlap each other, the plurality of input repair lines IRL can be electrically connected to the plurality of lines connected to the input terminals of the adjacent driving stages DS1 to DS(n), and the plurality of output repair lines ORL can be electrically connected to the plurality of lines connected to the output terminals of the adjacent driving stages DS1 to DS(n).

As described above with reference to FIGS. 5A and 5B, the portion where the gate line GL and the repair line RL are welded is defined as a welding point WP.

Referring to FIG. 5A, the center of the portion where the gate line GL overlaps with the repair line RL can be welded. In other words, the welding point WP can be located at the center of the portion where the gate line GL overlaps with the repair line RL. Accordingly, the gate line GL and the repair line RL are physically connected with each other at the welding point WP, and can be electrically connected with each other.

Alternatively, referring to FIG. 5B, a corner of the portion where the gate line GL overlaps with the repair line RL can be welded. Specifically, the welding point WP can be located at the corner of the portion where the gate line GL overlaps with the repair line RL. Accordingly, the gate line GL and the repair line RL are physically connected with each other at the welding point WP, and can be electrically connected with each other.

In addition, even if a first welding fails on a corner of the portion, a second welding can be attempted at another corner. Accordingly, the repair efficiency of the gate driver can be increased.

According to the method according to an exemplary embodiment of the present disclosure, even if the first driving stage DS1 among a plurality of driving stages DS1 to DS(n) included in the gate driver is defective, the respective one of the repairing stages RS1 to RS(n) can replace the defective first driving stage DS1.

In this manner, the other driving stages DS2 to DS(n) connected to the first repairing stage RS1 can also work normally, and thus the gate driver 400 can work normally even though the first driving stage DS1 is defective.

Hereinafter, a method of repairing a gate driver according to another exemplary embodiment will be described. This method can be implemented using any gate driver of the present disclosure.

The method according to this exemplary embodiment is different from the method according to the above-described exemplary embodiment in welding an input repair line IRL. The description will focus on the difference with reference to FIG. 6.

Referring to FIG. 6, cutting a defective driving stage includes cutting all of the Q-node, the QB-node and the output terminals of the (n−1)th driving stage DS(n−1) if it is determined that the carry-voltage output unit Tuc, Tdc and C1 and the gate-voltage output unit Tug, Tdg and C2 of the (n−1)th driving stage DS(n−1) are defective.

The cutting the Q-node of the (n−1)th driving stage DS(n−1) means that the Q-node control unit DQ and the Q-node are electrically separated from the (n−1)th driving stage DS(n−1).

The cutting the QB-node of the (n−1)th driving stage DS(n−1) means that the QB-node control unit DQB and the QB-node are electrically separated from the (n−1)th driving stage DS(n−1).

The cutting the output terminals of the (n−1)th driving stage DS(n−1) means that the (n−1)th carry line and the (n−1)th gate line are electrically separated from the output terminals of the (n−1)th driving stage DS(n−1).

In the welding the plurality of repair lines, the first input repair line IRL1 is welded at the portion where it overlaps with the output terminal of the Q-node control unit DQ of the cut (n−1)th driving stage DS(n−1). By doing so, the Q-node of the nth repairing stage RS(n) can be electrically connected to the output terminal of the Q-node control unit DQ of the (n−1)th driving stage DS(n−1).

The second input repair line IRL2 is welded at the portion where it overlaps with the output terminal of the QB-node control unit DQB of the cut (n−1)th driving stage DS(n−1). By doing so, the QB-node of the nth repairing stage RS(n) can be electrically connected to the output terminal of the QB-node control unit DQB of the (n−1)th driving stage DS(n−1).

By performing the welding, a signal output from the Q-node control unit DQ of the (n−1)th driving stage DS(n−1) can be applied to the Q-node of the nth repairing stage RS(n), and a signal output from the QB-node control unit DQB of the (n−1)th driving stage DS(n−1) can be applied to the QB-node of the nth repairing stage RS(n).

As a result, even if the carry-voltage output unit Tuc, Tdc and C1 and the gate-voltage output unit Tug, Tdg and C2 of the (n−1)th driving stage DS(n−1) are defective, the carry-voltage output unit Tuc, Tdc and C1 and the gate-voltage output unit Tug, Tdg, and C2 of the nth repairing stage RS(n) can work on behalf of the them.

As a result, according to the exemplary embodiment of the present disclosure, it is also possible to solve the issue of the gate driver 400 when the (n−1)th driving stage DS(n−1) is defective.

Additionally, unlike the method according to the above-described exemplary embodiment, the method according to this exemplary embodiment requires cutting and welding only the Q-node and QB-node rather than all of the lines connected to the input terminals of the driving stage. As a result, the number of welding points can be reduced.

Accordingly, the method of repairing a gate driver according to this exemplary embodiment requires the easier process, and thus the repair time can be reduced.

The exemplary embodiments of the present disclosure can also be described as follows:

According to an aspect of the present disclosure, there is provided a gate driver including: a plurality of driving stages cascade connected; at least one repairing stage disposed between the plurality of driving stages; and a plurality of repair lines connected to the at least one repair stage. The plurality of repair lines overlap with a plurality of lines connected to the plurality of driving stages. The at least one repairing stage can replace a defective driving stage of the gate driver. In this manner, it is possible to solve or address the issue of failure or limitation of the gate driver.

Some of the plurality of repair lines can be electrically connected to some of the lines connected to the plurality of driving stages at portions where they overlap each other.

Some of the plurality of repair lines can be electrically connected to some of the lines connected to the plurality of driving stages at welding points of the portions where they overlap each other.

The welding points can be disposed at a center of the portions, respectively.

In another example, the welding points can be disposed at a corner of the portions, respectively.

The plurality of repair lines can comprise a plurality of input repair lines overlapping a plurality of lines connected to input terminals of the plurality of driving stages; and a plurality of output repair lines overlapping a plurality of lines connected to output terminals of the plurality of driving stages.

Each of the plurality of driving stages can comprise a plurality of pull-up transistors each controlled by a Q-node, a plurality of pull-down transistors each controlled by a QB-node, a Q-node control unit controlling the Q-node and a QB-node control unit controlling the QB-node.

Each of the at least one repairing stages can comprise a plurality of pull-up transistors each controlled by a Q-node, a plurality of pull-down transistors each controlled by a QB-node, a Q-node control unit controlling the Q-node and a QB-node control unit controlling the QB-node.

The input repair lines can comprise a first input repair line connected between an output terminal of a Q-node control unit of some of the plurality of driving stages and a Q-node of some of the at least one repairing stage and a second input repair line connected between an output terminal of a QB-node control unit of the some of the plurality of driving stages and a QB-node of the some of the plurality of repairing stages.

The at least one repairing stage can comprise a plurality of repairing stages equally spaced apart from one another.

A length of each of the plurality of repair lines can be inversely proportional to a number of the at least one repairing stage.

According to another aspect of the present disclosure, there is provided a method of repairing a gate driver, the method including detecting a defective driving stage from among a plurality of driving stages; cutting input terminals and output terminals of the defective driving stage; and welding the plurality of repair lines and the lines connected to the plurality of driving stages. In this manner, it is possible to solve or address the issue of failure or limitation of the gate driver.

The cutting the defective stage can comprise cutting a gate line and a carry line connected to the defective driving stage.

The welding the plurality of repair lines can comprise welding the plurality of repair lines at portions where they overlap the respective cut gate lines and at portions where they overlap the respective cut carry lines.

The cutting the defective driving stage can comprise cutting a low-level voltage supply line, a low-level voltage supply line, a carry clock signal supply line, a gate clock signal supply line and a gate-start signal supply line connected to the defective driving stage.

The welding the plurality of repair lines can comprise welding the plurality of repair lines at portions where they overlap the respective cut low-level voltage supply lines and at portions where they overlap the respective cut high-level voltage supply lines, welding the plurality of repair lines at portions where they overlap the respective cut carry clock signal supply lines and at portions where they overlap the respective cut gate clock signal supply lines, and welding the plurality of repair lines at portions where they overlap the respective cut gate-start signal supply lines.

The cutting the defective driving stage can comprise cutting a Q-node and a QB-node of the defective driving stage.

The welding the plurality of repair lines can comprise welding the plurality of repair lines at portions where they overlap the respective cut Q-nodes and at portions where they overlap the respective QB-nodes.

Although the exemplary embodiments of the present disclosure have been described in detail with reference to the accompanying drawings, the present disclosure is not limited thereto and can be embodied in many different forms without departing from the technical concept of the present disclosure. Therefore, the exemplary embodiments of the present disclosure are provided for illustrative purposes only but not intended to limit the technical concept of the present disclosure. The scope of the technical concept of the present disclosure is not limited thereto. Therefore, it should be understood that the above-described exemplary embodiments are illustrative in all aspects and do not limit the present disclosure. The protective scope of the present disclosure should be construed based on the following claims, and all the technical concepts in the equivalent scope thereof should be construed as falling within the scope of the present disclosure.

What is claimed is:

1. A gate driver comprising:

a plurality of driving stages cascade connected;

at least one repairing stage disposed between the plurality of driving stages; and a plurality of repair lines connected to the at least one repairing stage, wherein the plurality of repair lines overlap with a plurality of lines connected to the plurality of driving stages, wherein the plurality of repair lines comprise a plurality of input repair lines overlapping a plurality of lines connected to input terminals of the plurality of driving stages; and a plurality of output repair lines overlapping a plurality of lines connected to output terminals of the plurality of driving stages, wherein each of the plurality of driving stages comprises a plurality of pull-up transistors each controlled by a Q-node, a plurality of pull-down transistors each controlled by a QB-node, a Q-node control unit controlling the Q-node and a QB-node control unit controlling the OB-node, wherein each of the at least one repairing stages comprises a plurality of pull-up transistors each controlled by a Q-node, a plurality of pull-down transistors each controlled by a QB-node, a O-node control unit controlling the Q-node and a QB-node control unit controlling the QB-node, and wherein the input repair lines comprise a first input repair line connected between an output terminal of a Q-node control unit of some of the plurality of driving stages and a Q-node of some of the at least one repairing stage; and a second input repair line connected between an output terminal of a QB-node control unit of the some of the plurality of driving stages and a GB-node of the some of the at least one repairing stage.

2. The gate driver of claim 1, wherein some of the plurality of repair lines are electrically connected to some of the lines connected to the plurality of driving stages at portions where the some of the plurality of repair lines electrically connected to the some of the lines connected to the plurality of driving stages overlap each other.

3. The gate driver of claim 2, wherein some of the plurality of repair lines are electrically connected to some of the lines connected to the plurality of driving stages at welding points of the portions.

4. The gate driver of claim 3, wherein the welding points are disposed at a center of the portions, respectively.

5. The gate driver of claim 3, wherein the welding points are disposed at a corner of the portions, respectively.

6. The gate driver of claim 1, wherein the at least one repairing stage comprises a plurality of repairing stages equally spaced apart from one another.

7. The gate driver of claim 1, wherein a length of each of the plurality of repair lines is inversely proportional to a number of the at least one repairing stage.

8. The gate driver of claim 1, wherein the plurality of input repair lines are disposed on a different layer and electrically separated from the plurality of lines connected to input terminals of the plurality of driving stages, and wherein the plurality of output repair lines are disposed on a different layer and electrically separated from the plurality of lines connected to output terminals of the plurality of driving stages.

9. The gate driver of claim 1, wherein each of the plurality of driving stages further comprises a plurality of capacitors for bootstrapping.

10. A method of repairing a gate driver including a plurality of driving stages cascade connected, at least one repairing stage disposed between the plurality of driving stages, and a plurality of repair lines connected to the at least one repairing stage and overlapping with a plurality of lines connected to the plurality of driving stages, the method comprising:

detecting a defective driving stage from among the plurality of driving stages;

cutting input terminals and output terminals of the defective driving stage; and welding the plurality of repair lines and the lines connected to the plurality of driving stages, wherein the cutting the input terminals and the output terminals of the defective driving stage comprises cutting a Q-node and a QB-node of the defective driving stage.

11. The method of claim 10, wherein the cutting the input terminals and the output terminals of the defective stage comprises:

cutting a gate line and a carry line connected to the defective driving stage.

12. The method of claim 11, wherein the welding the plurality of repair lines comprises:

welding the plurality of repair lines at portions where the plurality of repair lines overlap the respective cut gate lines and at portions where the plurality of repair lines overlap the respective cut carry lines.

13. The method of claim 10, wherein the cutting the input terminals and the output terminals of the defective driving stage comprises:

cutting a low-level voltage supply line, a high-level voltage supply line, a carry clock signal supply line, a gate clock signal supply line and a gate-start signal supply line connected to the defective driving stage.

14. The method of claim 13, wherein the welding the plurality of repair lines comprises:

welding the plurality of repair lines at portions where the plurality of repair lines overlap the respective cut low-level voltage supply lines and at portions where the plurality of repair lines overlap the respective cut high-level voltage supply lines, welding the plurality of repair lines at portions where the plurality of repair lines overlap the respective cut carry clock signal supply lines and at portions where the plurality of repair lines overlap the respective cut gate clock signal supply lines, and welding the plurality of repair lines at portions where the plurality of repair lines overlap the respective cut gate-start signal supply lines.

15. The method of claim 10, wherein the welding the plurality of repair lines comprises welding the plurality of repair lines at portions where the plurality of repair lines overlap the respective cut Q-nodes and at portions where the plurality of repair lines overlap the respective QB-nodes.

16. The method of claim 10, wherein the plurality of repair lines comprise:

a plurality of input repair lines overlapping a plurality of lines connected to input terminals of the plurality of driving stages; and a plurality of output repair lines overlapping a plurality of lines connected to output terminals of the plurality of driving stages.

17. The method of claim 16, wherein the plurality of input repair lines are disposed on a different layer and electrically separated from the plurality of lines connected to input terminals of the plurality of driving stages, and wherein the plurality of output repair lines are disposed on a different layer and electrically separated from the plurality of lines connected to output terminals of the plurality of driving stages.

* * * * *